US011918099B2

(12) United States Patent
Rey

(10) Patent No.: US 11,918,099 B2
(45) Date of Patent: Mar. 5, 2024

(54) SALON CHAIR POWER PACK

(71) Applicant: Beniah Rey, Boca Raton, FL (US)

(72) Inventor: Beniah Rey, Boca Raton, FL (US)

( * ) Notice: Subject to any disclaimer, the term of this patent is extended or adjusted under 35 U.S.C. 154(b) by 653 days.

(21) Appl. No.: 17/095,775

(22) Filed: Nov. 12, 2020

(65) Prior Publication Data

US 2021/0145152 A1 May 20, 2021

Related U.S. Application Data

(60) Provisional application No. 62/935,290, filed on Nov. 14, 2019.

(51) Int. Cl.

| | |
|---|---|
| ***A45D 44/04*** | (2006.01) |
| ***A47C 7/22*** | (2006.01) |
| ***A47C 7/62*** | (2006.01) |
| ***A47C 31/11*** | (2006.01) |

(52) U.S. Cl.

CPC ..... *A45D 44/04* (2013.01); *A47C 7/22* (2013.01); *A47C 7/622* (2018.08); *A47C 31/11* (2013.01)

(58) Field of Classification Search

CPC ..... A45D 44/02; A45D 44/04; A45D 44/06; A47C 1/11; A47C 7/22; A47C 7/622; A47C 31/11

USPC ..... 297/188.06

See application file for complete search history.

(56) References Cited

U.S. PATENT DOCUMENTS

| | | | | | |
|---|---|---|---|---|---|
| 2,531,217 | A * | 11/1950 | Johnson | A47C 1/04 | 312/226 |
| 2,767,895 | A * | 10/1956 | Smith | B60R 7/043 | 224/563 |
| 3,044,828 | A * | 7/1962 | Fowler | A47C 1/08 | 297/188.06 |
| 3,112,971 | A * | 12/1963 | Eck | A47C 1/11 | 191/1 R |
| 3,235,305 | A * | 2/1966 | Dlouhy | A47C 1/11 | 297/188.05 |
| 3,479,085 | A * | 11/1969 | Weinstein | B60N 2/60 | 297/228.1 |
| 5,379,903 | A * | 1/1995 | Smith | H02G 11/02 | 132/289 |
| 5,547,393 | A * | 8/1996 | Jansen | A45D 44/02 | 219/242 |
| 5,950,826 | A * | 9/1999 | Lykowski | A45D 1/00 | 206/349 |
| 6,170,680 | B1 * | 1/2001 | Hung | A47C 1/11 | 211/119.007 |
| 6,216,927 | B1 * | 4/2001 | Meritt | B60R 11/0235 | 296/37.16 |
| 6,808,066 | B2 * | 10/2004 | Bean | A45D 1/00 | 206/349 |

(Continued)

*Primary Examiner* — James M Ference

(74) *Attorney, Agent, or Firm* — GrayRobinson, P.A.; Michael J. Colitz, III

(57) ABSTRACT

A salon chair power pack comprising a body having multiple pockets on a front face with straps for attaching the invention to a stylist's chair. The invention further comprises a plurality of plugs, retention hooks, and an extendable male plug for the organization of cords associated with stylist tools which can be stored in the pockets. Preferably, the invention includes a plurality of female plugs so that multiple stylist tools can be used at once when styling a customer's hair. Alternatively, the power pack can be built into the seat back of the salon chair to form a power pack system.

6 Claims, 9 Drawing Sheets

(56) References Cited

U.S. PATENT DOCUMENTS 8,938,888 B1 * 1/2015 Brown ..... A45D 20/00 132/212
9,216,692 B2 * 12/2015 Brinster ..... B60R 7/005
9,516,950 B1 * 12/2016 Osweiler ..... A47C 7/622
9,809,174 B1 * 11/2017 Torres ..... A47C 7/72
9,814,315 B2 * 11/2017 Osweiler ..... A47C 7/622
D864,118 S * 10/2019 Rey ..... D13/139.8
2004/0140282 A1 * 7/2004 Wang ..... A47F 7/146 211/113
2005/0106935 A1 * 5/2005 Pena ..... H01R 25/003 439/501
2006/0207956 A1 * 9/2006 Sivers ..... A47G 29/00 211/113
2007/0278206 A1 * 12/2007 Pittman ..... A45D 2/00 219/225
2009/0184077 A1 * 7/2009 Curet ..... A45D 44/04 211/113
2011/0248531 A1 * 10/2011 Powell ..... A47C 1/11 297/163
2012/0175372 A1 * 7/2012 Cooper ..... A45D 44/04 220/486
2013/0175415 A1 * 7/2013 Mathieu ..... F16M 11/00 248/176.2
2013/0264851 A1 * 10/2013 Kim ..... B60N 2/879 297/217.3
2013/0299481 A1 * 11/2013 Stephens ..... A45D 44/04 219/222
2015/0278786 A1 * 10/2015 Ruggiero ..... G07F 9/009 601/99
2015/0282596 A1 * 10/2015 Davis ..... A47F 7/0028 242/400
2016/0081458 A1 * 3/2016 Sullivan ..... A45D 44/06 361/679.01
2016/0270516 A1 * 9/2016 Stephens ..... A45D 44/02
2017/0086586 A1 * 3/2017 Osweiler ..... H05K 5/0217
2017/0164772 A1 * 6/2017 Laderer-Alber ..... A45D 44/06
2017/0215556 A1 * 8/2017 Sullivan ..... F16M 11/04
2018/0070726 A1 * 3/2018 Osweiler ..... A47C 1/11
2018/0103744 A1 * 4/2018 Moore ..... A45D 1/00
2019/0357682 A1 * 11/2019 Osweiler ..... A47C 1/11
2021/0145152 A1 * 5/2021 Rey ..... A47C 1/11

* cited by examiner

SALON CHAIR POWER PACK

CROSS-REFERENCE TO RELATED APPLICATION

This application claim priority to U.S. Provisional Patent Application No. 62/935,290 titled "Salon Chair Power Pack" filed Nov. 14, 2019, the contents of which are hereby incorporated by reference herein.

BACKGROUND OF THE INVENTION

Field of the Invention

This invention relates to a device for providing power and storage for barber and salon professionals. More specifically, this invention relates to a device having a plurality of pockets, sockets, and adapters that can be attached to the back of a salon or barber's chair.

Description of the Background Art

The average barber stores the tools of the trade on a bench nearby the chair which the customer sits in to get their hair cut. This can be inconvenient as the cord for the clippers can get in the way and serve as a tripping hazard. Further, a disorganized barber or stylist could easily misplace one of their tools. Other storage units on the market fail to provide the modularity that most stylists require in terms of storage.

Presently, there exists a need for a device which can store a stylist's tools as well as provide power to the stylist's clippers and other devices which require power. Therefore, it is an object of this invention to provide an improvement which overcomes the aforementioned inadequacies of the prior art devices and provides an improvement which is a significant contribution to the advancement of the device storage art.

Another object of this invention is to provide a device which has a plurality of pockets for the storage of stylist tools.

Another object of this invention is to provide a device which has customizable storage space.

Another object of this invention is to provide a device which can power a plurality of devices for stylist use.

Another object of this invention is to provide a device which can reach wall plugs while still allowing stylists free range to use stylist tools such as clippers without worrying about tripping over cords.

Another object of this invention is to provide a device which can be attached to the back of a stylist's chair and removed with ease.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a body having multiple pockets on a front face with straps for attaching the invention to a stylist's chair. The invention further comprises a plurality of plugs, retention hooks, and an extendable male plug for the organization of cords associated with stylist tools which can be stored in the pockets. Preferably, the invention includes a plurality of female plugs so that multiple stylist tools can be used at once when styling a customer's hair.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
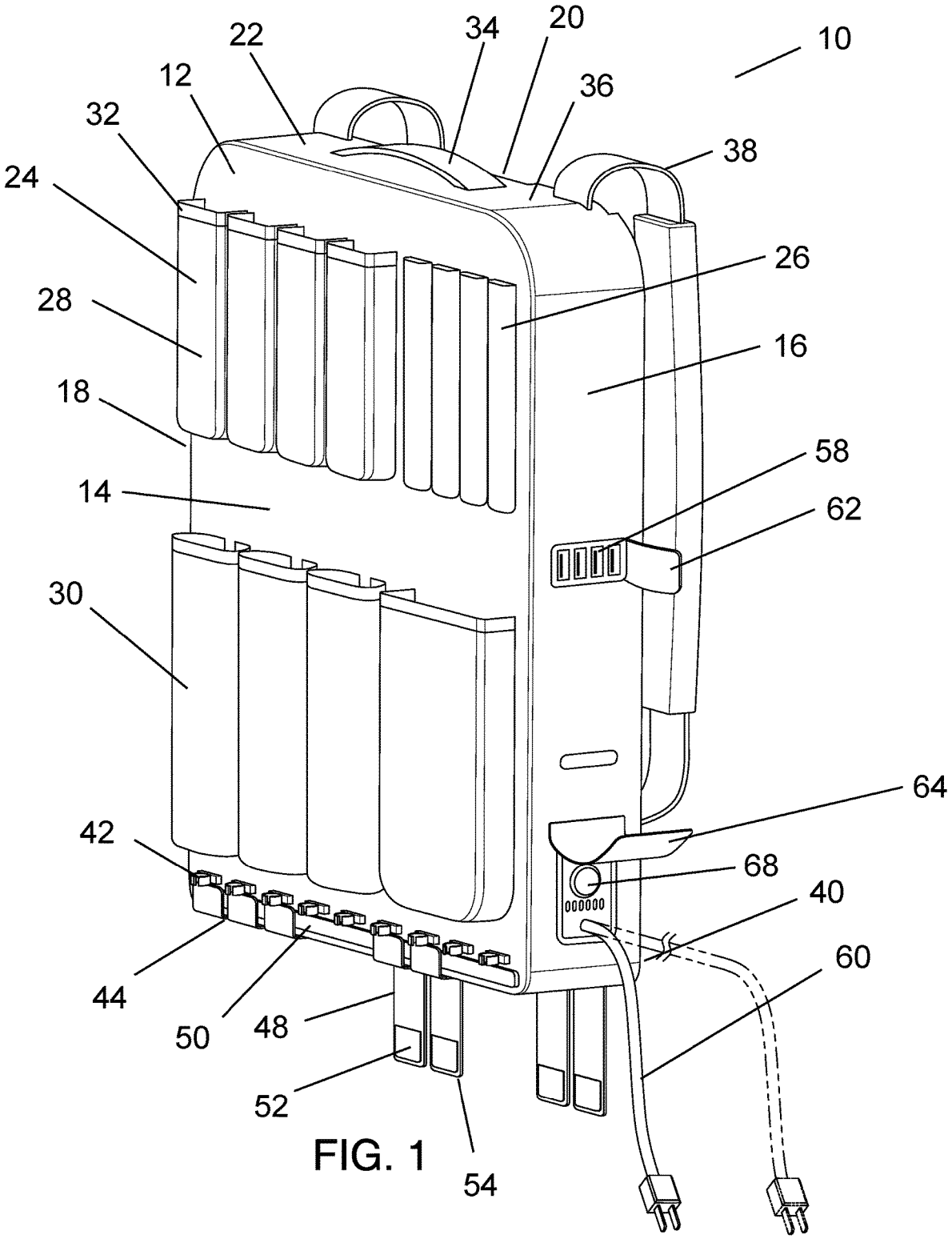
FIG. 1 is a right side perspective view of the device.
Figure 2:
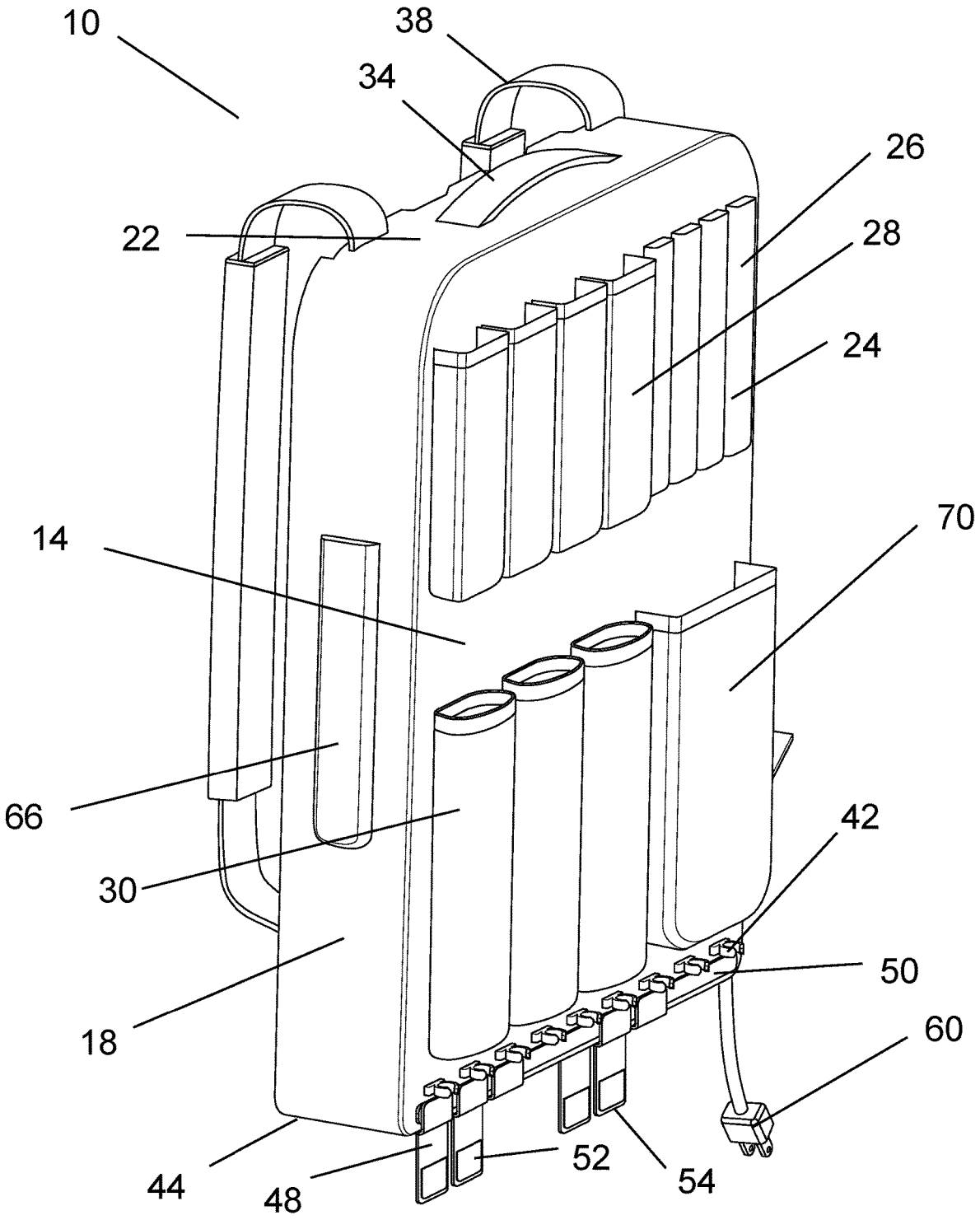
FIG. 2 is a left side perspective view of the device.

As can be seen in FIGS. 1-5, the salon chair power pack 10 comprises a main body 12. The main body 12 comprises a front face 14, a right side face 16, a left side face 18, a rear face 20, and a top face 22. The main body 12 is preferably made of cloth, although leather could also be used, and is preferably filled with a heat resistant material to provide structure and to protect the chair or the client. On the front face 14, the salon chair power pack 10 has a plurality of pockets 24 attached to the front face 14 by conventional means such as sewing or glue. The pockets 24 can come in a variety of shapes and sizes but the salon chair power pack preferably has a mix of small pockets 26, medium pockets 28, and large pockets 30 to accommodate tools of a variety of shapes and sizes. These pockets 24 may also have an upper lining 32 to prevent wear and tear and for decorative purposes.

Figure 3:
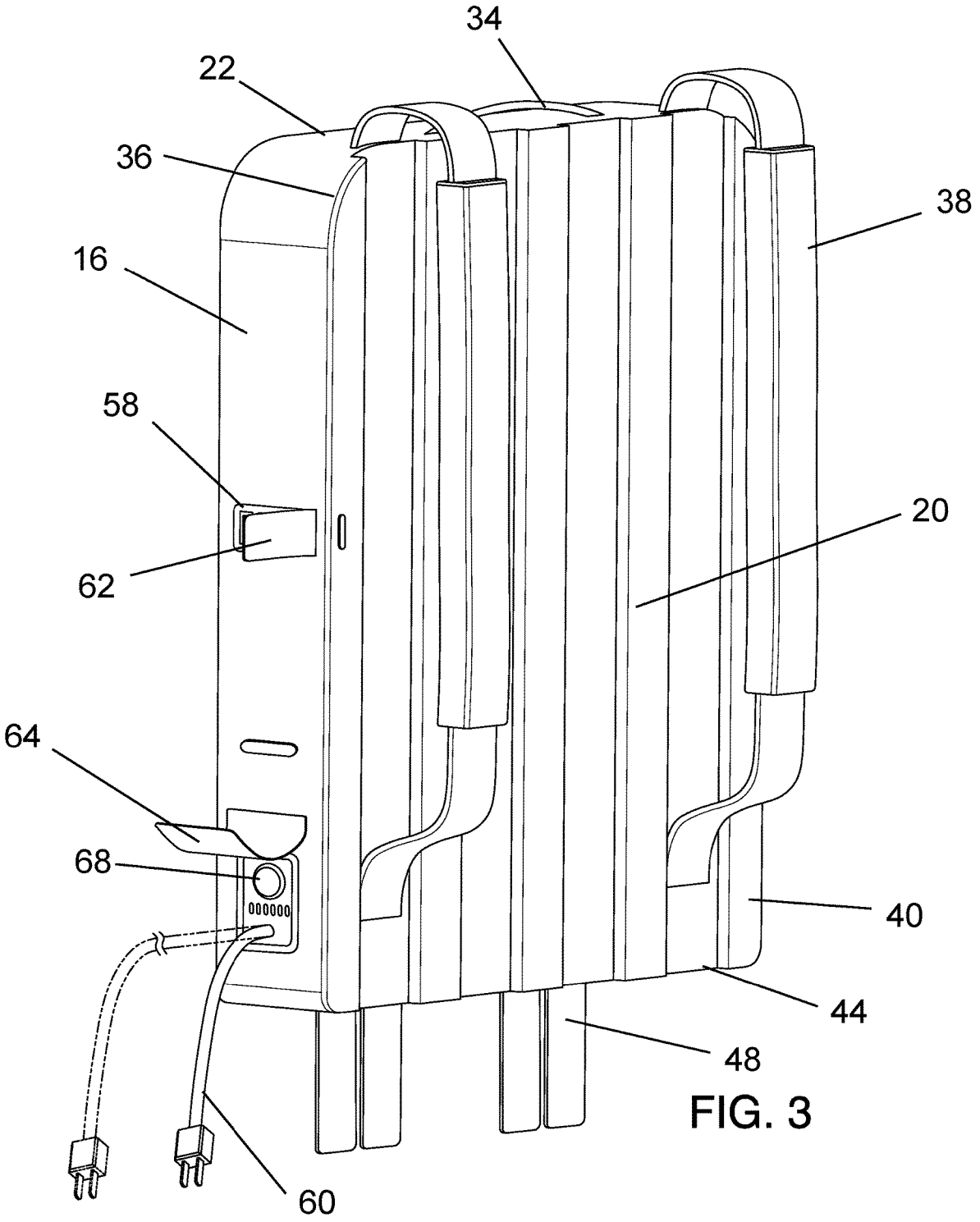
FIG. 3 is a rear perspective view of the device.

The top face 22 also preferably has a handle 34 to allow the stylist to better handle the salon chair power pack 10 when moving the salon chair power pack 10 from place to place. At least two straps 38 begin on the top face 22 at a proximal end 36 of the salon chair power pack 10 and terminate near a distal end 40 of the salon chair power pack 10, as can be seen in FIG. 3. Located at the distal end 40 of the front face 14 lies a plurality of retention hooks 42 which are used to keep the cords from the stylist's tools organized and out of the way. Preferably below the retention hooks 42 is a retention strip 50 which has a length that runs from the right side face 16 to the left side face 18 and is preferably magnetic. Alternatively, instead of using magnets, the strip could be made from hook and loop material. Also located at the distal end 40 on a bottom face 44 are a plurality of female plugs 46 which allow for the stylist to plug in devices which require power for use such as clippers. Each of the female plugs 46 can be covered by a fastening band 48 which has a magnet 52 (alternatively the other half of hook and loop material) located at a band distal end 54 which allows for the fastening band 48 to removably couple to the magnetic strip 50. The fastening band 48 is attached to the salon chair power pack 10 on the bottom face 44 at a proximal end 56 of the fastening band 48.

Figure 4:
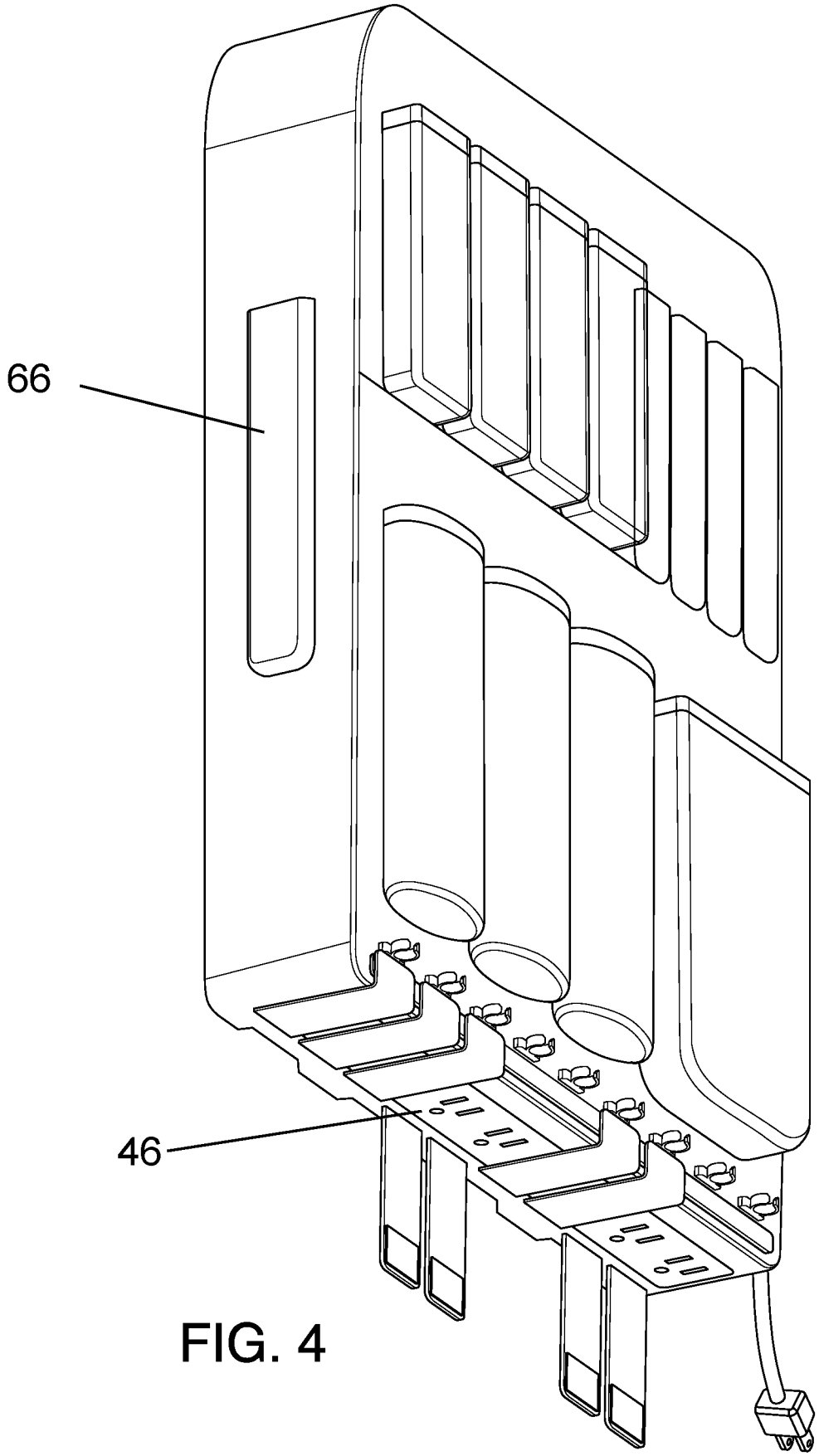
FIG. 4 is a bottom perspective view of the device.
Figure 5:
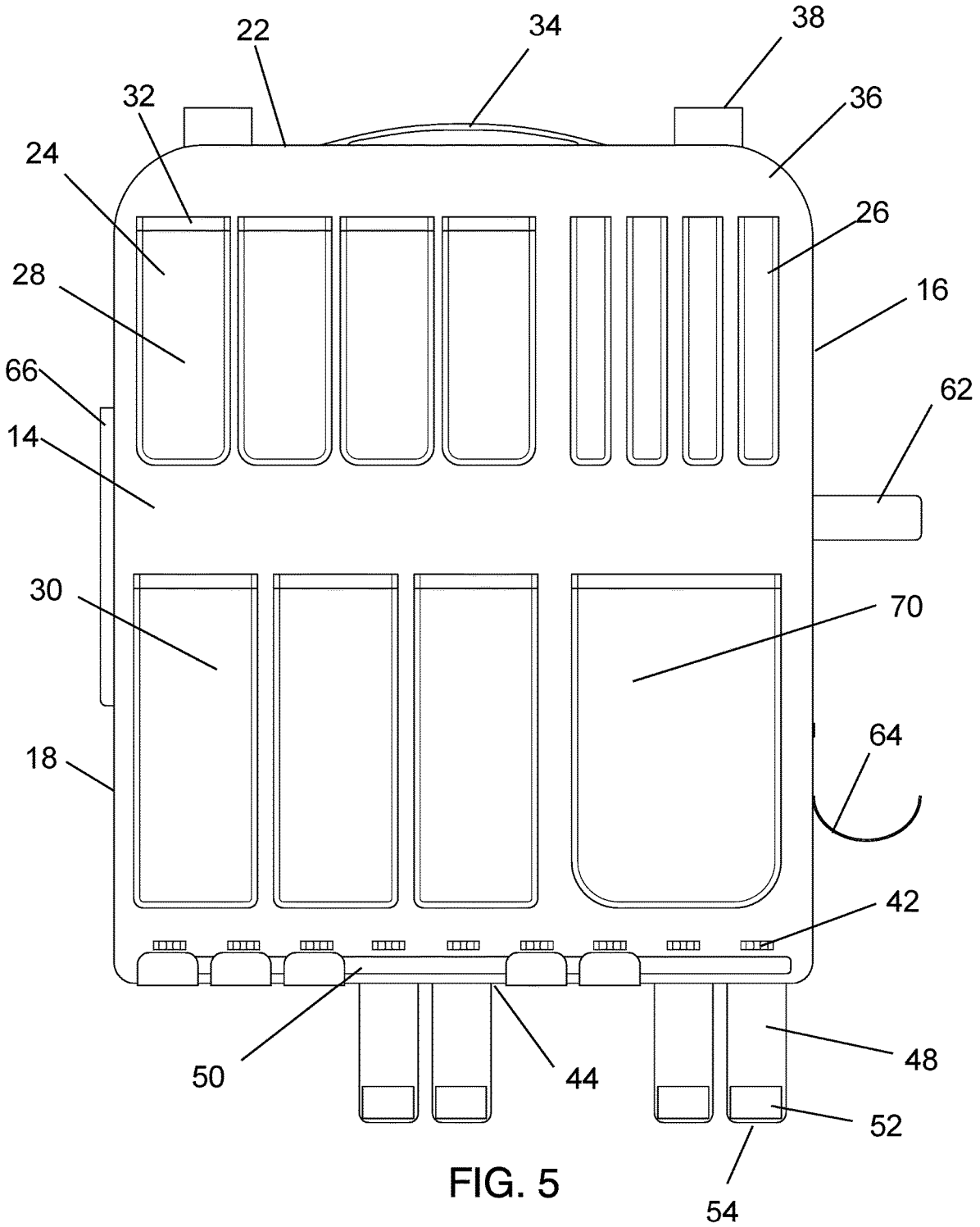
FIG. 5 is a front view of the device.
Figure 6:
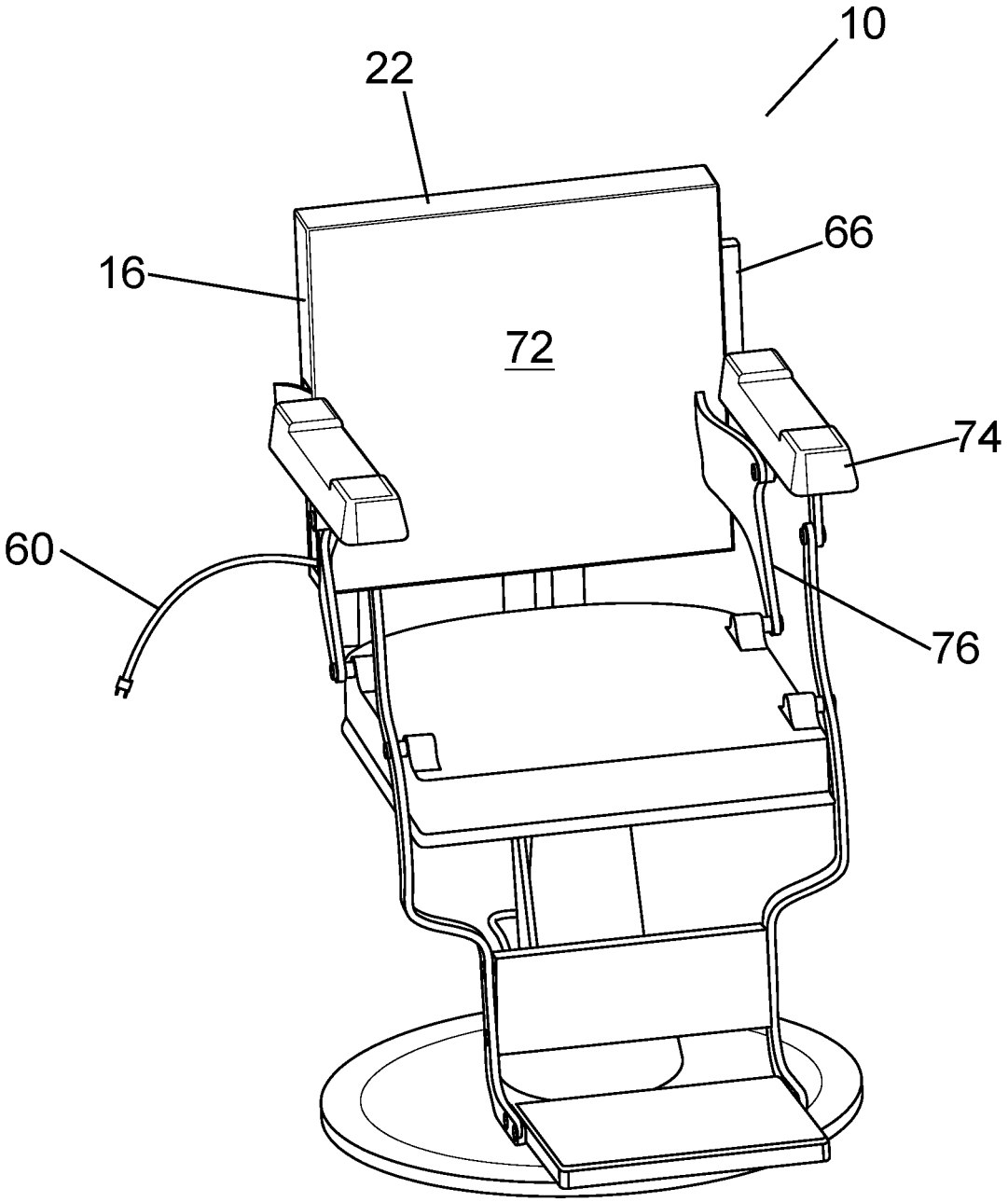
FIG. 6 is a front view of an alternative embodiment of the device.
Figure 7:
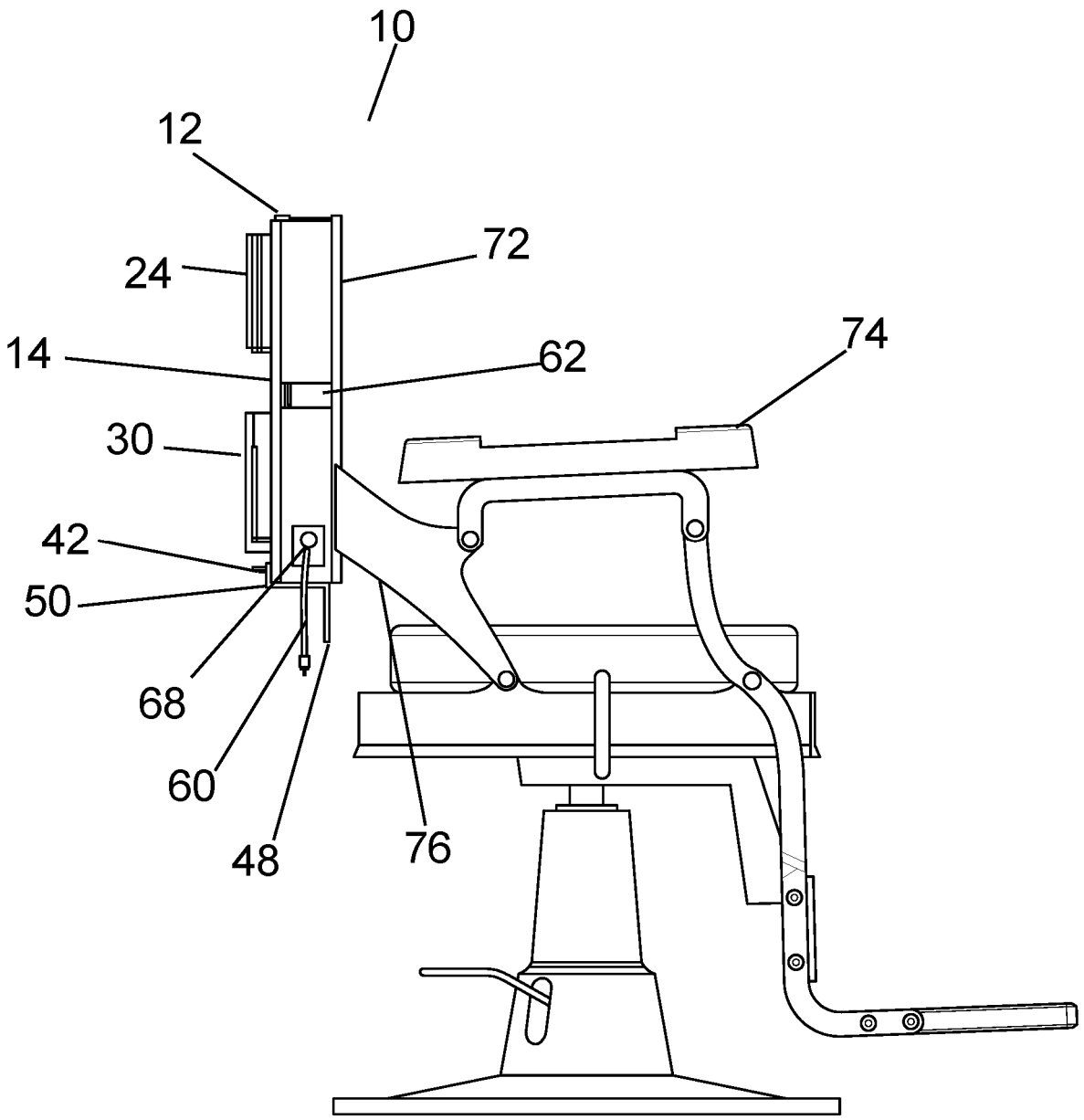
FIG. 7 is a side view of an alternative embodiment of the device.
Figure 8:
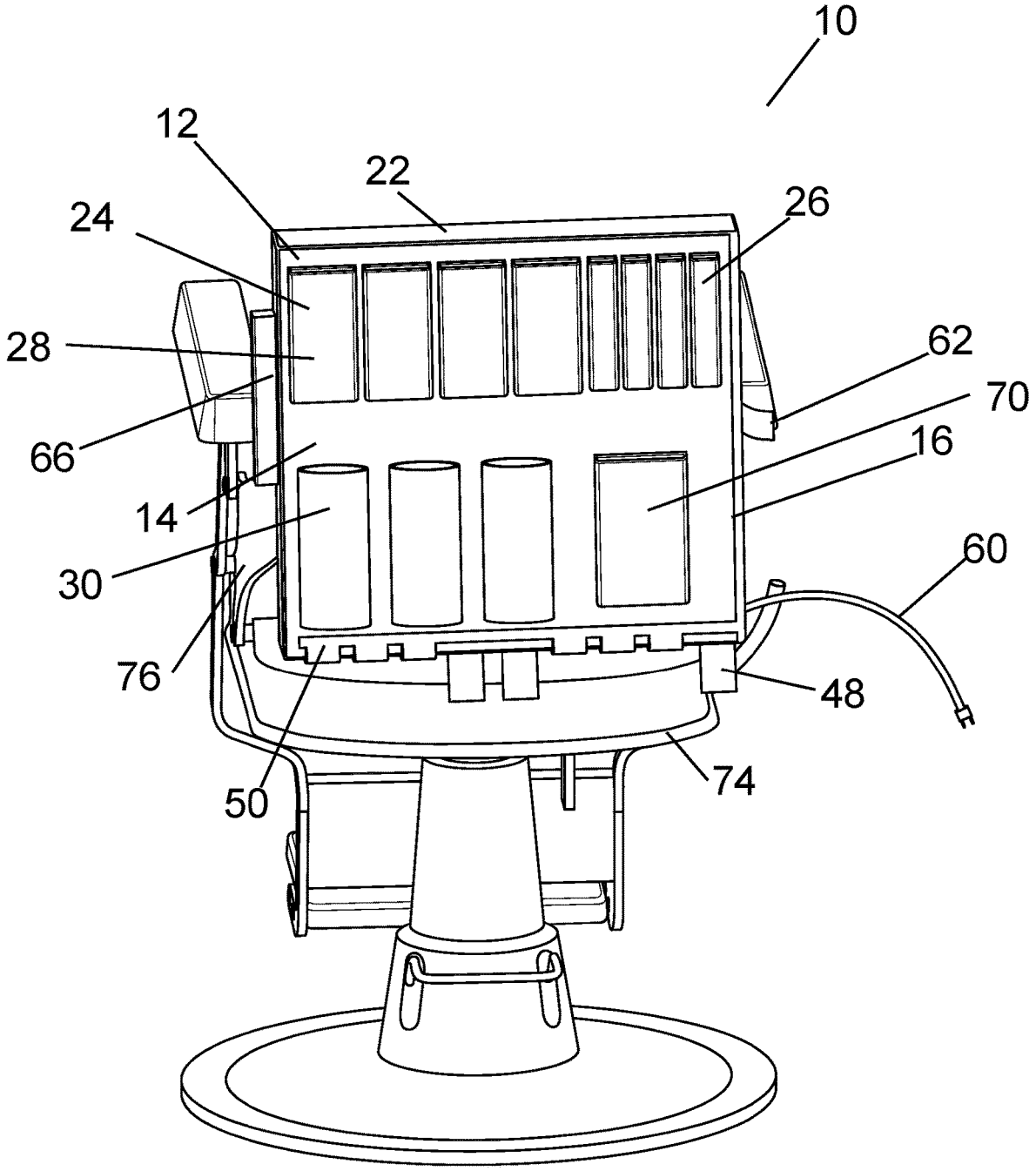
FIG. 8 is a rear view of an alternative embodiment of the device.
Figure 9:
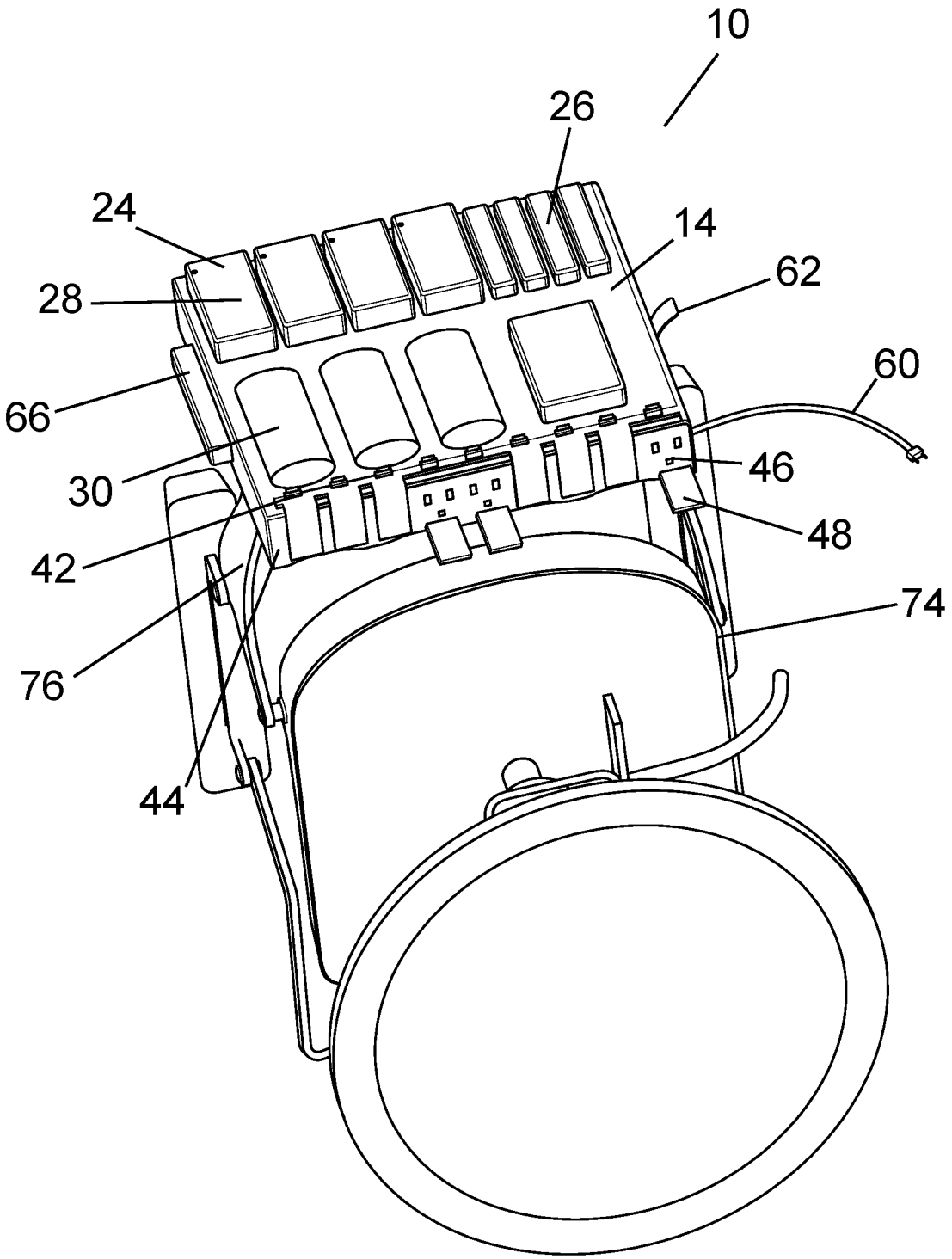
FIG. 9 is a bottom perspective view of an alternative embodiment of the device.

Further, the salon chair power pack 10 further comprises a plurality of USB connections 58 and an extendable male electrical plug 60 on either the right side face 16 or the left side face 18. The USB connections 58 may also have a USB covering 62 and the male electrical plug 60 may have a plug covering 64. The extendable plug 60 can be retracted into the main body 12 through the use of a return button 68. Preferably, the salon chair power pack 10 further comprises a side pocket 66 on either the right side face 16 or left side face 18, preferably whichever side the USB connections 58 and male electric plug 60 are not located, as seen in FIG. 4. As shown in FIG. 5, one of the large pockets 30, can instead be an extra-large pocket 70 so as to hold larger stylist tools such as air dryers.

An alternative embodiment is provided in FIGS. 6-9 wherein the salon chair power pack 10 is incorporated into the seatback 72 of a chair 74 with a set of chair mounts 76. Preferably, the chair 74 is a barber or salon chair but the chair 74 can be any style of chair where power and storage may be needed. When incorporated into the seatback 72, the salon chair power pack 10 still has all of the features described when produced as a stand-alone device. Much like the stand-alone version, the salon chair power pack 10 is filled with heat-resistant material to prevent overheating the chair 74 or the customer also comfortable for the customer to rest their back against.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A salon chair power pack comprising:

a main body comprising an internal cavity, a front face, a right side face, a left side face, a rear face, a top face, and a bottom face, and further comprising a heat resistant material that fills the internal cavity;

a plurality of pockets attached to the front face, each of the plurality of pockets further comprising a lining;

at least two straps attached at a proximal end to the top face and at a distal end to the rear face;

a handle attached to the top face;

a plurality of retention hooks wherein a retention strip is adjacent to the plurality of retention hooks;

a plurality of female plug ports built into the bottom face;

a plurality of fastening bands attached to the bottom face;

a plurality of universal serial bus ports;

an extendable, retractable male electrical plug electrically connected to the plurality of female plug ports and the plurality of universal serial bus ports to provide power; and at least one side pocket built into either the right side face or the left side face.

2. The salon chair power pack of claim 1 wherein the main body further comprises an outer material made of cloth.

3. The salon chair power pack of claim 1 wherein the main body further comprises an outer material made of leather.

4. The salon chair power pack of claim 1 wherein the retention strip is magnetic.

5. The salon chair power pack of claim 1 wherein the retention strip comprises a hook and loop material.

6. A salon chair power pack system comprising:

a salon chair comprising a seat back and chair mounts, the seat back attached to the salon chair by the seat mounts, the seat back further comprising:

a main body comprising an internal cavity, a front face, a right side face, a left side face, a rear face, a top face, and a bottom face, and further comprising a heat resistant material that fills the internal cavity;

a plurality of pockets attached to the front face, each of the plurality of pockets further comprising a lining;

a plurality of retention hooks wherein a retention strip is adjacent to the plurality of retention hooks;

a plurality of female plug ports built into the bottom face;

a plurality of fastening bands attached to the bottom face;

a plurality of universal serial bus ports;

an extendable, retractable male electrical plug electrically connected to the plurality of female plug ports and the plurality of universal serial bus ports to provide power; and at least one side pocket built into either the right side face or the left side.

* * * * *